US006470535B1

(12) United States Patent
Mayne et al.

(10) Patent No.: US 6,470,535 B1
(45) Date of Patent: Oct. 29, 2002

(54) CAMMING BELT CLIP

(75) Inventors: Doug Mayne, Weber County; Dave Jones, Davis County, both of UT (US)

(73) Assignee: Iomega Corporation, Roy, UT (US)

( * ) Notice: Subject to any disclaimer, the term of this patent is extended or adjusted under 35 U.S.C. 154(b) by 0 days.

(21) Appl. No.: 09/861,923

(22) Filed: May 21, 2001

(51) Int. Cl.[7] ..... A45F 5/00

(52) U.S. Cl. ..... 24/3.12; 24/3.1; 24/3.11; 224/197; 224/269; 361/814; 455/351

(58) Field of Search ..... 24/3.12, 3.11, 24/3.7, 3.8, 3.1, 182, 530; 361/814; 224/269, 197, 198; 455/351

(56) References Cited

U.S. PATENT DOCUMENTS

| | | | | |
|---|---|---|---|---|
| 4,828,153 | A | 5/1989 | Guzik et al. | |
| 5,014,892 | A | 5/1991 | Copeland | |
| 5,081,709 | A | 1/1992 | Benyo et al. | |
| 5,097,997 | A | 3/1992 | Kipnis et al. | |
| 5,274,885 | A * | 1/1994 | Hellweg | 24/3.1 |
| 5,379,490 | A | 1/1995 | Wandt et al. | |
| 5,528,770 | A | 6/1996 | Castilla et al. | |
| 5,791,019 | A | 8/1998 | Jeong | |
| 5,819,379 | A | 10/1998 | Van Hout et al. | |
| 5,850,954 | A * | 12/1998 | Dong-Joo | 224/197 |
| 5,979,019 | A | 11/1999 | Johnson | |
| 6,006,969 | A * | 12/1999 | Kim | 224/197 |
| 6,018,848 | A | 2/2000 | Nilsen et al. | |
| 6,032,337 | A | 3/2000 | Rankin, Jr. et al. | |
| 6,064,577 | A | 5/2000 | Moskowitz et al. | |
| 6,125,513 | A | 10/2000 | Cheraso et al. | |
| 6,145,169 | A | 11/2000 | Terzuola et al. | |
| 6,161,741 | A * | 12/2000 | French | 224/198 |
| 6,188,881 | B1 | 2/2001 | Braxton | |
| 6,283,348 | B1 * | 9/2001 | Wang | 224/197 |

FOREIGN PATENT DOCUMENTS

| | | |
|---|---|---|
| EP | 0 868 864 | 10/1998 |
| JP | 7 326 869 | 12/1995 |
| JP | 11 18818 | 1/1999 |
| JP | 11 40952 | 2/1999 |
| JP | 018 3550 | 6/2000 |

* cited by examiner

*Primary Examiner*—Victor Sakran

(57) ABSTRACT

A belt clip for attaching a device to a user includes a back plate having first and second wing portions which include flanges for engaging with the exterior surface of an electronic device. The first and second wing portions are coupled together by an integrated biasing portion that allows the first and second wing portions to be forced together when the flanges are gripping the electronic device and apart when it is desired to remove the electronic device from the belt clip. The wing portions each include integrally formed cam members that engage with a cam hole formed in a clip member. As the clip member is rotated relative to the back plate, the cam members and thus the wing portions are brought together to grasp the electronic device. The clip member is then retained relative to the back plate with a locking feature.

32 Claims, 8 Drawing Sheets

SECTION A-A (DETAIL A)

MOLDED POSITION

SECTION B-B

ASSEMBLY POSITION

SECTION C-C

OPEN POSITION

SECTION D-D

CLOSED POSITION

CAMMING BELT CLIP

BACKGROUND

1. Field of the Invention

The present invention relates to an apparatus for attaching an electronic device to the belt or other article of clothing of a user. More particularly, the present invention relates to a belt clip which is releasably securable to an electronic device for ease of attachment and removal therefrom.

2. Description of the Prior Art

The use of various mechanisms for attaching electronic devices to an article of clothing of a user has been known for decades. Some of the first widely used mechanisms for attaching electronic devices to a user were loops of fabric integrated into a fabric case used to support and protect small personal cassette players manufactured by Sony, Toshiba and others. Such belt clip devices were commonly comprised of a relatively wide loop of fabric sewn to the case.

Because it is often desirable to access the front of the electronic device, it is often not preferred to encase the device in a fabric sleeve. Thus, various devices have been developed to provide a belt clip while not interfering with the functionality of the device.

The following references provide samples of the most common ways that belt clips are assembled and attached to various electronic devices. U.S. Pat. No. 6,032,337 to Rankin, Jr. et al. comprises a spring loaded belt clip assembly for attachment to a cellular phone. The belt clip of Rankin, Jr. et al., however, is comprised of several separate components that increase the cost of the device and require assembly of the components. Furthermore, the belt clip is held in place merely by the force of a single coil spring and is not lockable onto the electronic device. As such, the belt clip could be accidentally disengaged from the electronic device allowing the electronic device to drop to the ground.

Likewise, U.S. Pat. No. 5,791,019 to Jeong is comprised of multiple components including pins and springs that require a specifically configured slots and components to be integrated into the case of the electronic device.

The detachable belt clip assembly of U.S. Pat. No. 4,828,153 to Guzik et al. simply snaps over the exterior of an electronic device but requires the use of a screwdriver for removal which may damage the external surface of finish of the electronic device. Furthermore, the belt clip portion is not configured to wrap around the belt of a user and may therefore become easily separated from the user.

As illustrated by the foregoing examples, prior art belt clips are typically comprised of multiple components requiring at least some assembly by the manufacturer. Moreover, many of the prior art devices require significant alteration, modification, or adaptation of the case of the electronic device to accept the prior art belt clip assemblies. Furthermore, some of the prior art belt clip assemblies require various components to be permanently attached to the electronic device in order for the belt clip to even be attachable thereto. Finally, many of the known belt clip assemblies in the art are relatively difficult and expensive to manufacture.

Thus, it would be advantageous to provide a belt clip assembly that is comprised of a minimal number of components, can be adapted to attach to most all electronic devices, is easy to manufactured as all components can be injection molded, does not require any preassembly of components, is easy to remove from the electronic device without damaging the electronic device and provides a secure attachment of the belt clip to the electronic device and the belt clip to the user.

SUMMARY OF THE INVENTION

The belt clip of the present is preferably configured for attaching an electronic or other device to an article of clothing of a user. In addition, the belt clip is easy and inexpensive to manufacture and is comprised of a minimal number of components.

The belt clip of the present invention is also preferably configured to be attached to an electronic or other device in a manner that is easy for the user to attach and remove from the device.

The belt clip of the present invention is also preferably configured to be gentle on the device to which it is to be attached such that it will not damage the surface when the belt clip is attached or removed.

The belt clip of the present invention is further preferably configured so as to not require the addition of features or parts to the device to which the belt clip is to be attached and thus does not increase the cost of the device to which the belt clip of the present invention can be attached.

The belt clip of the present invention is also preferably configured to provide a belt clip that does not hide or detract from the industrial design of the device to which the belt clip of the present invention is attached. Specifically, the belt clip of the present invention is preferably configured so as to not substantially cover the front or any substantial portion of the front of the device to which it is attached.

The belt clip of the present invention also preferably creates a strong attachment force between the belt clip and the device when secured thereto.

Accordingly, a camming belt clip in accordance with the principles of the present invention is preferably comprised of a back plate portion and a clip portion that are rotatably engage relative to one another in a manner that rotation of the clip portion actuates the back plate portion in a clamping manner to grip the exterior of another device, such as a portable electronic device for playing music. The back plate or clamping member preferably includes integrally formed first and second wing portions interconnected by an arch-shaped portion or member that biases the wing portions relative to one another. The arch-shaped portion defines a circular aperture between the wing portions having a diameter sufficient to minimize lateral stress in and subsequent fracturing of the arch-shaped portion as the arch-shaped portion is flexed.

In a preferred embodiment, each of the wing portions includes grasping or gripping flanges integrally formed therewith for engaging with external features of an electronic device and securely holding the electronic device relative to the back plate.

A pair of cam members are preferably provided for actuating the first and second wing portions relative to one another. As such, one cam member is attached to the first wing portion and the other cam member is attached to the other wing portion and are in such a proximity so as to be receivable within a cam hole provided in the clip portion.

The clip portion preferably defines a cam hole for receiving the cam members and is rotatable relative to the said first and second cam members, said belt clip member being rotatable relative to the back plate between a first open position and a second closed position, whereby rotation of the clip member from the first open position to the second closed position forces the first cam member toward the second cam member thus forcing the first wing portion toward the second wing portion to allow the grasping flanges to move into engagement with the electronic device.

The grasping flanges are preferably spaced from a back side of the back plate and inwardly extend from proximate the outer edges of the wing portions so as to partially wrap around an electronic device and engage with exterior features provided in the sides of such an electronic device. As such, it is preferable that the grasping flanges substantially match the exterior contour of the electronic device to which the flanges are to be attached.

In order to provide relatively uniform top and bottom surfaces of the back plate, that is to keep the top and bottom surfaces of the first and second wing portions in substantially the same plane, the wing portions are each preferably provided with overlapping recesses to allow a portion of the first wing to overlap with a corresponding yet opposite portion of the second wing when the first and second wing portions are brought together in accordance with the principles of the present invention. This overlap of the wings provides structural stability to the back plate as well as a preferred design from an aesthetic perspective since the top surface of the back plate will appear uniform, that is, in the same plane.

In another preferred embodiment of the present invention, a laterally extending post extends from the first wing portion for engaging with a top surface of the second wing portion. The post and overlapping recesses prevent relative movement of the first and second wing portions in a direction perpendicular to a plane defined by their top surfaces.

In yet another preferred embodiment, the belt clip of the present invention includes a cantilevered locking member which is integrally formed with one of the wing members. The locking member is provided with a raised locking portion for engaging with a corresponding recess in the clip member when the clip member is in the closed position. The raised locking portion is preferably integrally formed with the cantilevered locking member which is flexible relative to the wing portion for selective disengagement of the raised locking portion from the clip member when the cantilevered locking member is sufficiently flexed.

In still another preferred embodiment of the belt clip in accordance with the principles of the present invention, the cam members include cam stops for abutting against cam stop abutments provided in the clip portion. The cam stops prevent over rotation of the clip portion relative to the back plate in either direction. Thus, the cam stop members and said cam stop abutments allow the clip portion to rotate approximately ninety degrees relative to said cam members between the open position and the closed position. Preferably, the clip portion is provided with first and second open position cam stop abutments for abutting against the cam stops and preventing over rotation of the clip portion in a first direction and first and second closed position cam stop abutments for abutting against the cam stops and preventing over rotation of the clip portion in a second direction.

When the clip portion is in the closed position, the grasping flanges are preferably closer together and move apart as the clip portion is rotated about the cam members to the open position. This movement of grasping flanges is accomplished by the biasing of the arch-shaped portion which forces the cam members against the cam hole.

The clip portion preferably comprises an integrally formed cam portion defining the cam hole and including the cam abutment surfaces and a belt loop portion for securing the device of the present invention to a user.

The advantages of a belt clip in accordance with the present invention will become more apparent from a reading of the following description of the preferred embodiments.

BRIEF DESCRIPTION OF THE DRAWINGS

The foregoing summary, as well as the following detailed description of the preferred embodiments is better understood when read in conjunction with the appended drawings. For the purpose of illustrating the invention, there is shown in the drawings embodiments that are presently preferred and which illustrate what is currently considered to be the best mode for carrying out the invention, it being understood, however, that the invention is not limited to the specific embodiments disclosed. In the drawings.

DETAILED DESCRIPTION OF THE PREFERRED EMBODIMENTS

Figure 1:
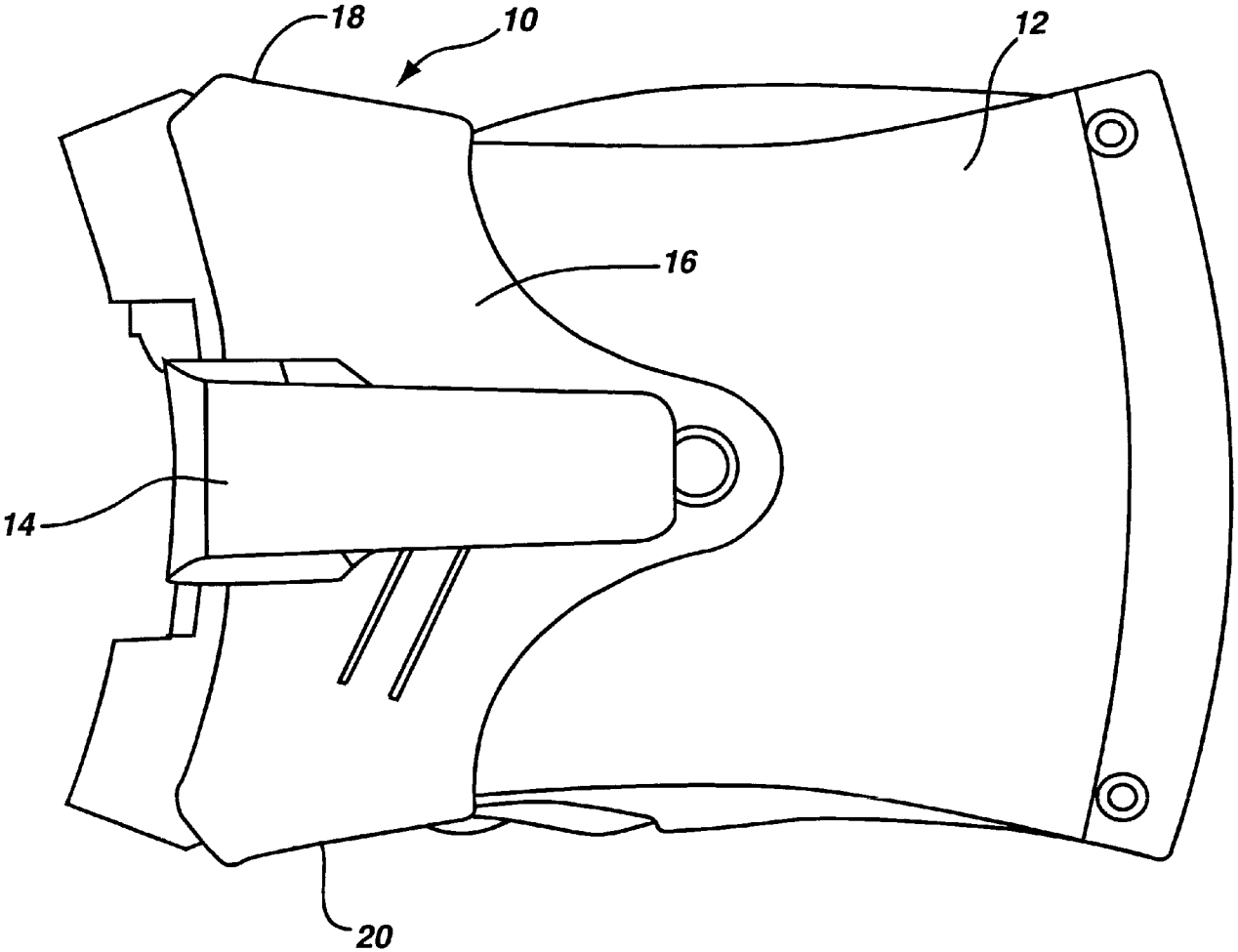
FIG. 1 is a top view of a camming belt clip in accordance with the principles of the present invention attached to an electronic device.

Referring to the drawings wherein like numerals indicate like elements throughout, there is shown in FIG. 1 a camming belt clip apparatus, generally indicated at 10, in accordance with the preferred embodiment of the present invention. The camming belt clip 10 is attached to an electronic device 12 to be worn on the belt or other article of clothing (not shown) of a user. In this preferred embodiment, the camming belt clip 10 is specifically configured for attaching to an MP3 player manufactured by Iomega Corporation and sold under the trademark HIPZIP. As will be described in more detail, herein, the camming belt clip 10 is configured to be removably attached to the electronic device 12 without requiring any modification of the structure, specifically the external case, of the electronic device 12.

The camming belt clip 10 is comprised of two components, a clip member 14 and a back plate 16. When the clip member 14 is positioned as shown in FIG. 1, the clip member 14 forces the sides 18 and 20 inwardly toward the electronic device 12 to clamp the back plate 16 to the electronic device 12. From this position, the clip member 14 must be manually "unlocked" from engagement with the back plate 16 in order to release the electronic device 12 from the black plate 16. Such a camming belt clip 10 provides selective attachment of the camming belt clip 10 to an electronic device while securely holding the electronic device 12 relative to the camming belt clip 10 so as to prevent the electronic device 12 from becoming separated from the camming belt clip 10 when subjected to sever vibration and jarring as is often the case when a user runs or jogs with such an electronic device 12 attached to an article of clothing.

Figure 2:
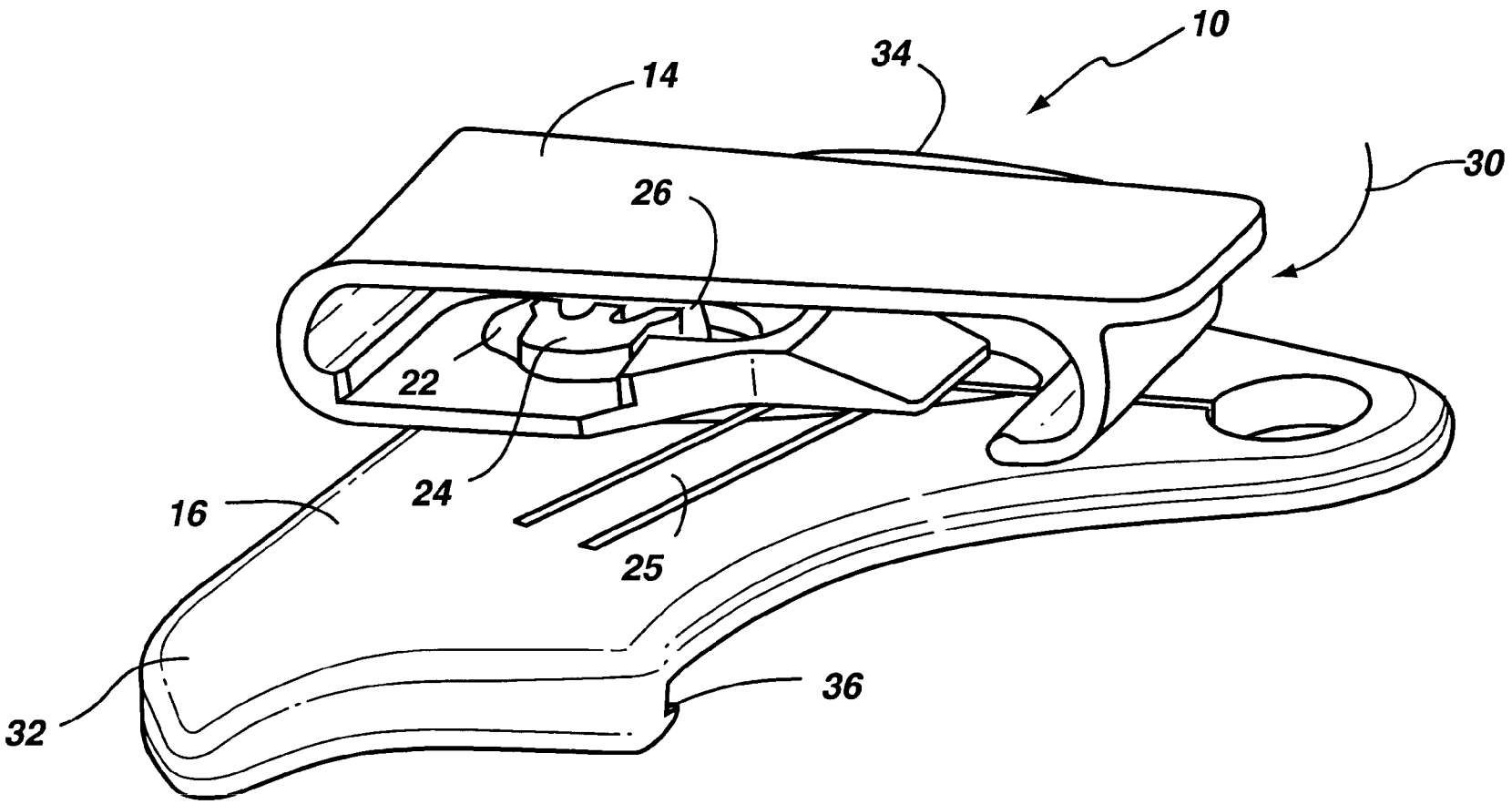
FIG. 2 is a perspective side view of the camming belt clip in its assembled form as shown in FIG. 1.

As better seen in FIG. 2, the clip member 14 defines a cam hole 22 that is configured to engage with cam members 24 and 26 attached to the back plate 16, hence the title "camming belt clip." The clip member 14 is shown in the locked position, i.e., when the back plate 16 is closed to grip an electronic device. In order to lock the clip member 14 relative to the back plate 16, the back plate 16 is provided with a cantilevered tab 25 that engages with a portion of the clip member 14 when the clip member 14 is in the locked position to hold the clip member 14 in place relative to the back plate 16 until the tab 25 is inwardly pressed. By simultaneously pressing the tab 25 and rotating the clip member 14 in the direction of arrow 30, the cam members 24 and 26 in combination with the cam hole 22 allow the wings 32 and 34 to spread apart thus releasing the electronic device. Each wing 32 and 34 is provided with a flange 36, only one of which is visible in FIG. 2, having a contour to match the outer contour of the device to which the back plate 16 is to be attached. The flanges 36 are received in elongate recesses formed into the exterior surface of the case of the electronic device.

Figure 3C:
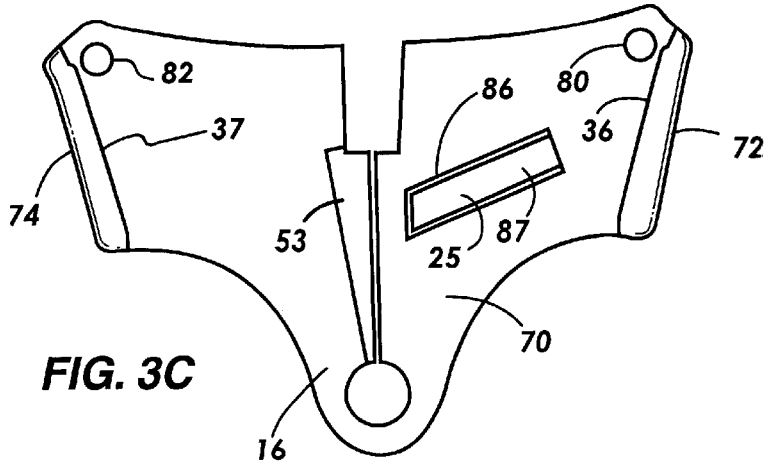
FIGS. 3A, 3B, 3C and 3D are top, end, bottom and side views, respectively, of a back plate portion of the camming belt clip in accordance with the principles of the present invention.
Figure 3D:
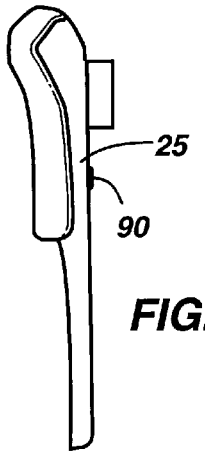
Figure 3B:
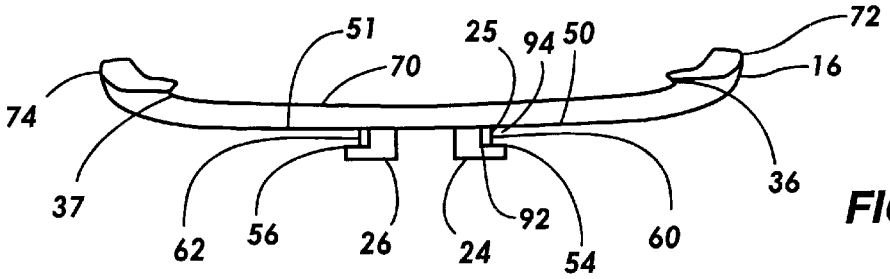
Figure 3A:
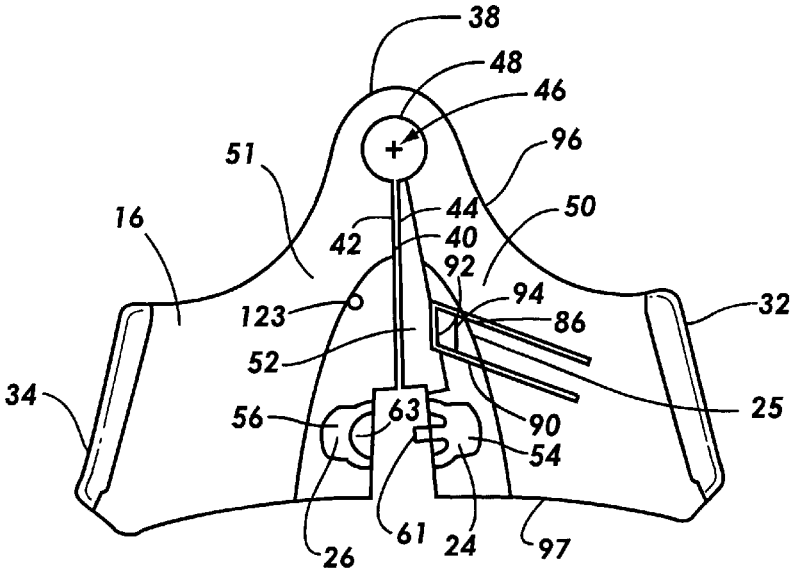
Figure 4C:
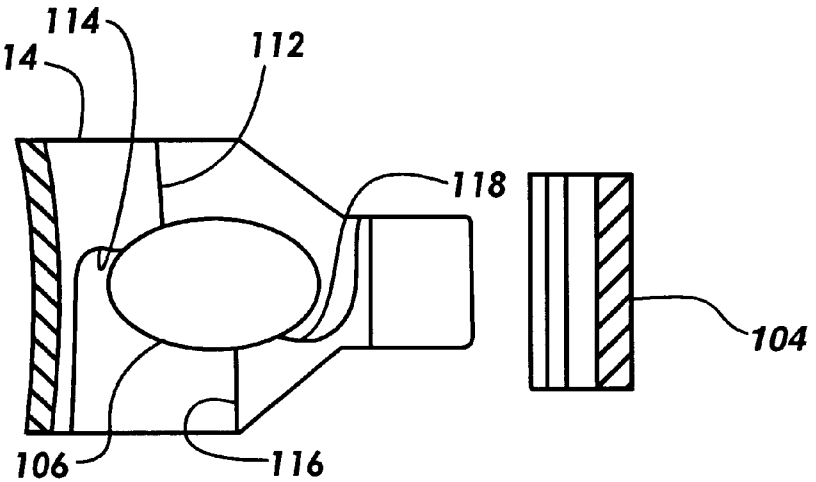
FIGS. 4A, 4B, 4C and 4D are bottom, side, partial cross-sectional top and end views, respectively, of a clip portion of the camming belt clip in accordance with the principles of the present invention.
Figure 4D:
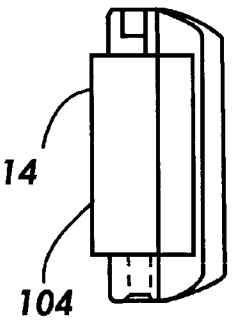
Figure 4B:
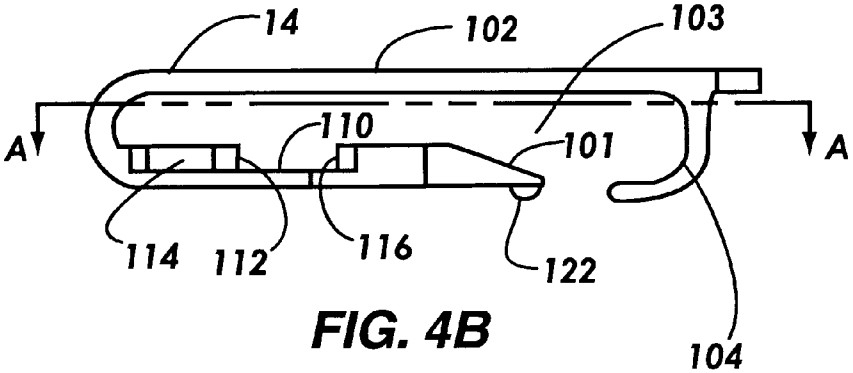
Figure 4A:
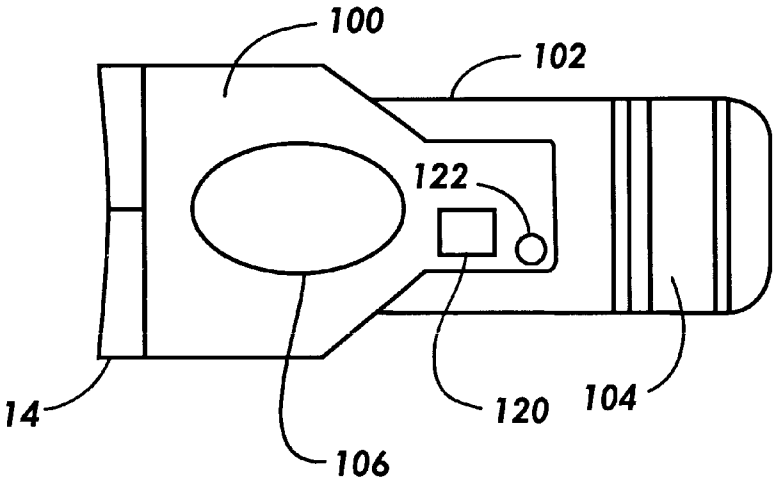

As further illustrated in FIGS. 3A, 3B, 3C and 3D, the back plate 16 is formed from a single integrated piece of material, preferably plastic, that has been injection molded into the shape shown in the top view of FIG. 3A. As illustrated in FIG. 3A, the back plate 16 includes a right wing portion 32 and a left wing portion 34 held together by an arch-shaped portion which holds the right and left wing portions 32 and 34 together and provides a bias between the right wing portion 32 and the left wing portion 34. When the back plate 16 is in a resting state as shown in FIG. 3A, that is, out of the mold, the right wing 32 and left wing 34 are separated by a relatively small gap 40 between the inside edges 42 and 44 of the right and left wing portions 32 and 34, respectively. For manufacturing purposes, such a design is preferable, since overlapping components would may molding of the back plate 16 from a single part more difficult.

The gap 40 extends from proximate the cam members 24 and 26 to a circular aperture 46 which defines the inner surface 46 of the arched portion 38. The thickness of the arched portion 38, is designed to allow the right and left wing members or portions 32 and 34 to move toward and away from one another in a plane substantially parallel to a plane defined by the paper upon which FIG. 3A is drawn, i.e., a plane substantially parallel to the top surface 50 of the back plate 16, while biasing the right wing portion 32 away from the left wing portion 34 when the right and left wing portions 32 and 34 are brought closer together. As the right and left wing portions 32 and 34 are brought together, a recessed or stepped down portion 52 is provided in the top surface 50 of the right wing portion 32 to allow the edge 42 of the left wing portion 34 to pass over the inside edge 44 of the right wing portion 32. As the edge 42 moves over the edge 44, the stepped down portion engages with a similarly but oppositely configured recessed or stepped down portion 53 in the back surface 70 of the back plate 16. Thus, when the back plate 16 is in a closed position as defined herein, the top surface 50 of the right wing portion 32 will substantially align with the top surface 51 fo the right wing portion 34 to provide a smooth and even top surface. Additionally, when the surfaces 52 and 53 engage one another their abutment provides relative stability of the wing portions 32 and 34.

The back plate 16 is also provided with a pair of cam members 24 and 26 which are attached to and extend upwardly from the right wing member 32 and left wing member 34, respectively. The cam members 24 and 26 are provided with cam caps 54 and 56, respectively, which serve a dual purpose. First, the cam caps 54 and 56 prevent the clip member 14 from becoming disengaged from the back plate 16 once attached thereto. Secondly, as will be more fully described herein, the side surfaces of the cam caps 54 and 56 prevent the clip member 14 from being rotated more than about 90 degrees from an open position to a closed position. In addition, the cam member 24 may include a laterally extending member or post 61 which extends from the cam member 24 toward the cam member 26. When the right and left wing portions 32 and 34 are brought together, i.e., in the closed position, the bottom side of the post 61 will rest upon the surface 63 to prevent transverse movement of the right and left wing members 32 and 34 in one direction. Likewise, as the edge 42 overlaps the edge 44, and the surfaces, 52 and 53 engage, transverse movement of the wing members 32 and 34 in the opposite direction such that the wing members 32 and 34 cannot substantially move relative to one another in a direction perpendicular to a plane defined by the top surface 51.

As further illustrated in FIG. 3B, the cam members 24 and 26 extend from the top surfaces 50 and 51 of the right and left wing portions 32 and 34, respectively. The cam members 24 and 26, provide cam followers 60 and 62, respectively, which provide the camming action of the present invention. Depending from the top of each cam follower 60 and 62 are cam caps 54 and 56 which abut against the clip member 14 (see FIG. 2) to prevent the clip member 14 from disengaging from the cam members 24 and 26 once attached thereto. The cam caps 54 and 56 provide an effective diameter that is greater than the effective diameter of the cam followers 60 and 62. As such, the cam caps 54 and 56 cantilever outwardly from the cam followers 54 and 56, respectively.

Referring also to FIG. 3C, the underside 70, that is, the side to which the electronic device (not shown) is to be attached, of the back plate 16 is provided with undercuts or flanges 36 and 37 proximate the outer edges 72 and 74, respectively, of the back plate 16. The flanges 36 and 37 protrude inwardly from the outer edges 72 and 74 and are spaced above the underside 70 essentially forming gripping members that are capable of wrapping around a portion of a device and engage with recessed features on an exterior surface of the device. When engaged with a device for which the flanges 36 and 37 are designed, the flanges 36 and 37 form a mechanical lock between the back plate 16 and the device. To give the flanges 37 and 38 sufficient gripping power and structural strength while maintaining their relative thinness, the flanges 37 and 38 extend approximately the length of the edges 72 and 74, respectively, of the back plate 16. Increasing their length in this manner, also gives the flanges a larger surface area for better grasping of the external surface of a device.

The underside of bottom surface 70 of the back plate 16 is also provided with a pair of posts 80 and 82 that extend upwardly from the bottom surface 70 for engaging with external features provided in the outer surface of a device to which the back plate 16 is attached. This is preferable to prevent the electronic device from sliding relative to the back plate 16. As further illustrated in FIGS. 3A–3D, the locking tab 25 is integrally formed with the back plate 16 and is defined by a thin channel 86 which extends completely through the back plate 16 and thus defines the locking tab 25. The locking tab 25 is a cantilevered member that, when depressed will flex relative to the back plate 16. Furthermore, the back surface 87 of the locking tab 25 is recessed to allow the locking tab 25 to deflect when the electronic device is abutted against the bottom surface 70 of the back plate 16. As shown in FIGS. 3A, 3B and 3D, the locking tab 25 is provide with a protruding locking portion 90 having a ramped surface 92 that allows the clamp member 14 to slide over while inwardly deflecting the tab portion 25 and for locking with the back side of abutment edge 94 of the locking portion 90 until the locking tab is manually depressed from the top surface 50.

should be noted that the outer contours 96 and 97, for example, of the back plate 16 are primarily configured from an industrial design aspect and may have other shapes and configurations depending upon the configuration of the device to which the back plate is to be attached.

Referring now to FIGS. 4A, 4B, 4C and 4D, the clip member 14 is comprised of a cam portion 100 and a belt retaining portion 102 including a belt hook 104. The cam portion 100, belt retaining portion 102 and belt hook 104 essentially form a nearly closed-loop defining a relatively thin aperture or interior channel 103 configured for receiving and securing therein between a belt of a user. With such a configuration, it is unlikely that the clip member 14 will become separated from the user when attached to a belt or strap. The inner side 110 of the cam portion 100 is provided with a leading ramped or tapered surface 101 for making insertion of a belt easier. The cam portion 100 defines an elliptical or oval cam hole 106 configured for receiving the cam members 24 and 26 of the back plate 16. When the cam portion 100 is attached to the back plate 16, the cam followers 60 and 62 engage with the interior surface of the cam hole 106. Rotation of the cam portion 100 relative to the cam followers 60 and 62 causes the cam followers to move closer together as the cam followers 60 and 62 move from the widest portion (the open position) of the cam hole 106 to the narrowest portion (the closed position). The interior side 110 of the cam portion 100 is provided with cam stop abutments 112, 114, 116 and 118 which abut against the side surfaces of the cam stops 54 and 56 to prevent over rotation in either direction of the clip member 14 relative to the cam members 24 and 26 thus only allowing the cam followers to move between the open position and the closed position.

The cam portion 100 is also provided with a rectangular recess 120 or lock stop for receiving the locking portion 90 of the locking tab 25 when the cam portion 100 has been rotated to the closed position relative to the back plate 16. In addition, to provide additional security a semispherical protrusion 122 may also be provided to engage with a recess 123 in the top surface 51 of the back plate 16 (see FIG. 3A).

The camming belt clip of the present invention provides a device that provides sufficient gripping action and tight engagement with the electronic device that the electronic device cannot easily become dislodged from the camming belt clip. In the preferred embodiment and in what is believed to be the best mode of the present invention, the camming belt clip is comprised of two components that can each be separately injection molded and easily assembled. FIGS. 5A, 5B, 6A, 6B, 6C, 7A, 7B, 7C, 8A, 8B and 8C illustrate in sequence the various positions of the back plate from the molded position shown in FIGS. 5A and 5B to the closed or locked position shown in FIGS. 8A, 8B and 8C the position in which the camming belt clip would be attached to an electronic device.

Figure 5B:
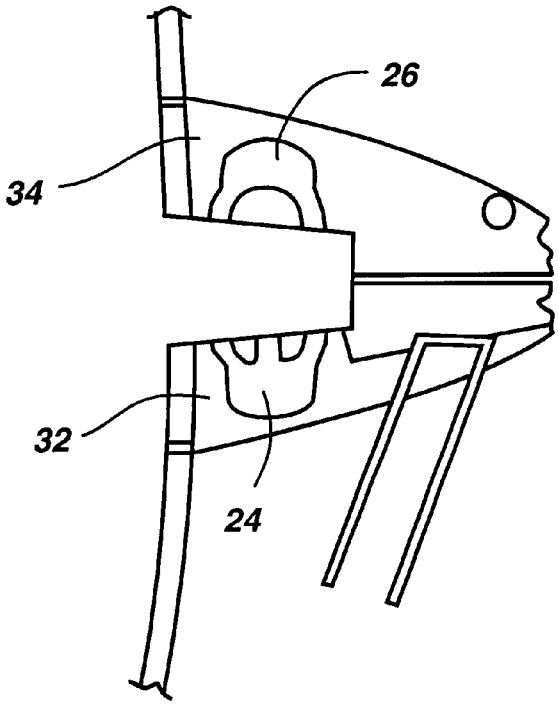
FIGS. 5A and 5B are a top view and partial top view, respectively, of the back plate portion of the present invention in a molded position.
Figure 5A:
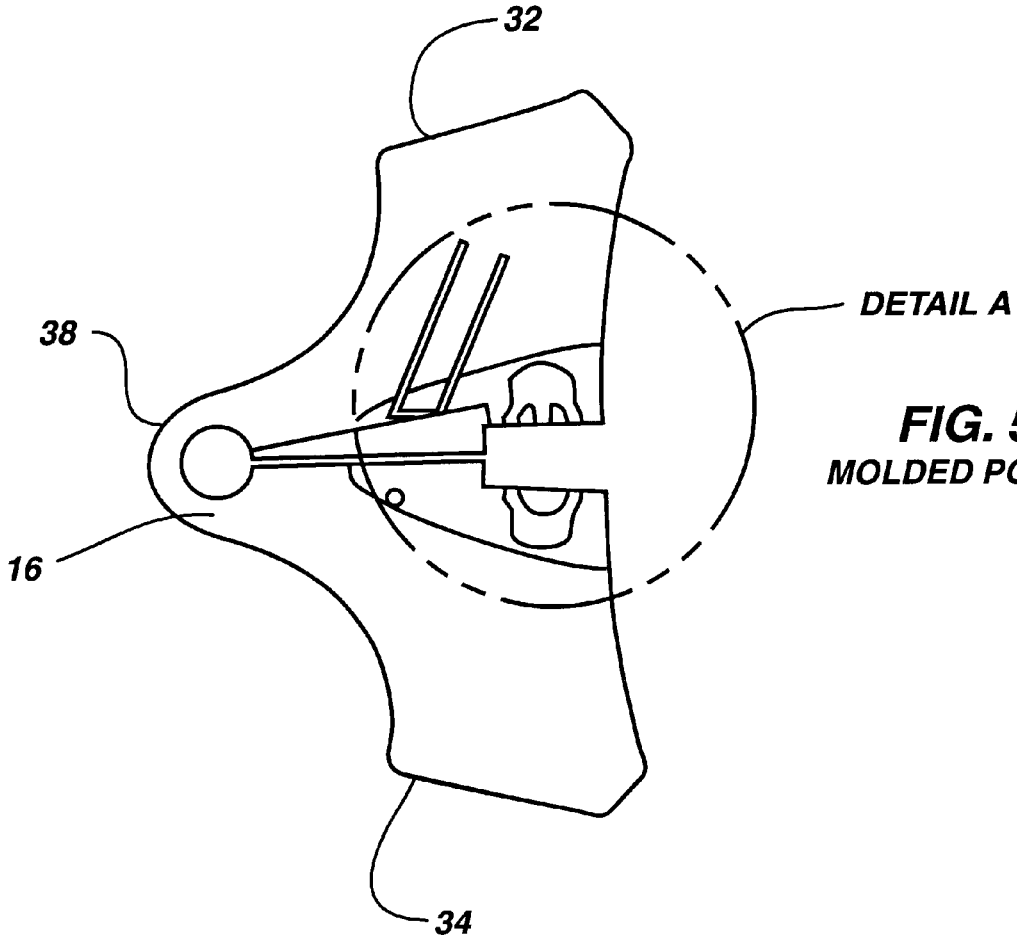

As shown in FIG. 5A and FIG. 5B (DETAIL A), the back plate 16 is shown in its "MOLDED POSITION" such that there is no overlap of the right and left wing members 32 and 34. The cam members 24 and 26 are at their widest spacing. Depending upon the modulus of elasticity of the material used to form the back plate and the thickness of the biasing portion 38, the cam members 24 and 26 are spaced to provide sufficient force against the cam hole of the clip member 14 when engaged therewith while allowing smooth operation of the cam arrangement.

Figure 6C:
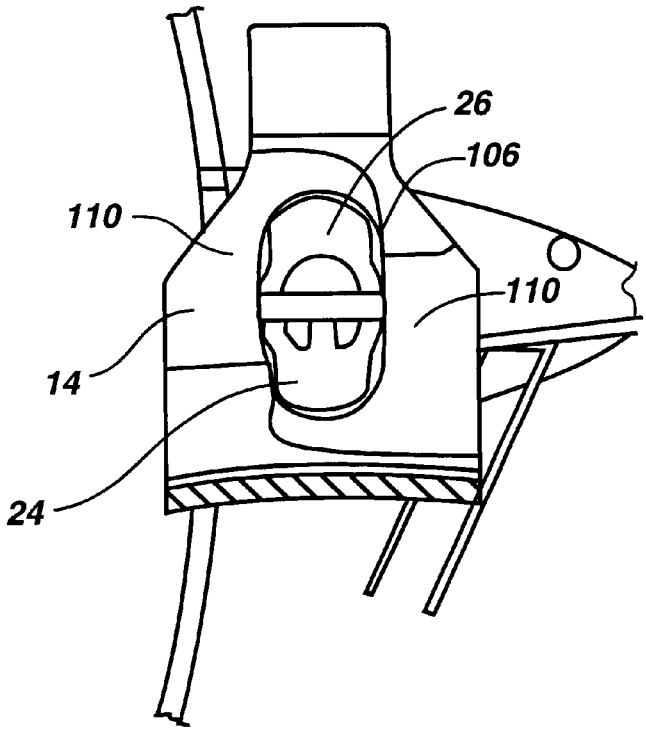
FIGS. 6A, 6B and 6C are top, side and partial cross-sectional top views of a camming belt clip in an assembly position in accordance with the principles of the present invention.
Figure 6B:
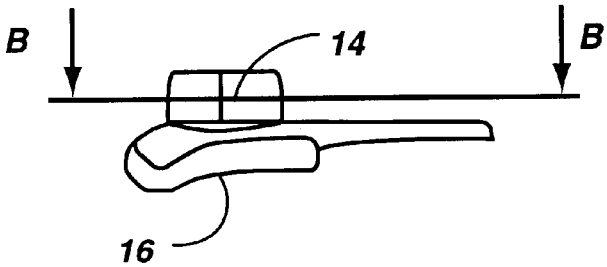
Figure 6A:
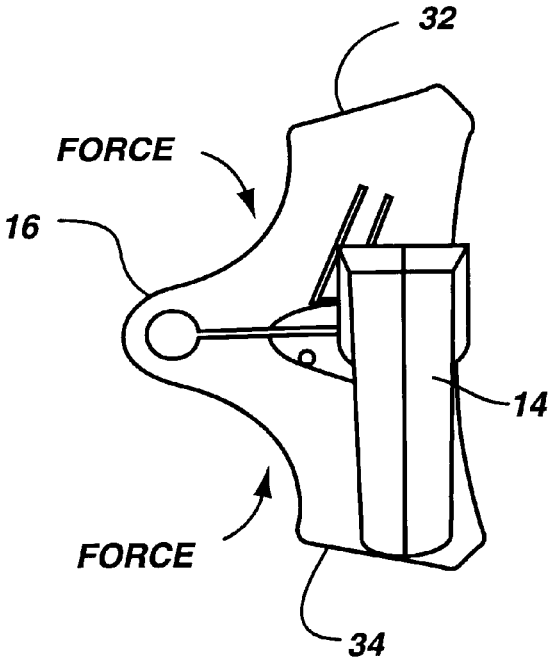

FIGS. 6A, 6B and 6C show the "ASSEMBLY POSITION" of the back plate 16. To assemble the clip member 14 to the back plate 16, a force (as shown by arrows) is applied to the back plate 16 to fully squeeze the right and left wing members 32 and 34 together. As illustrated in FIG. 6C, the cam hole 106 of the belt clip 14 is oriented relative to the cam members 24 and 26 such that the cam stops 54 and 56 align with the widest portion of the cam hole 106. The cam hole 106 is then inserted over the cam members until the cam stops 54 and 56 are above the surface 110 of the of the clip member 14.

Figure 7C:
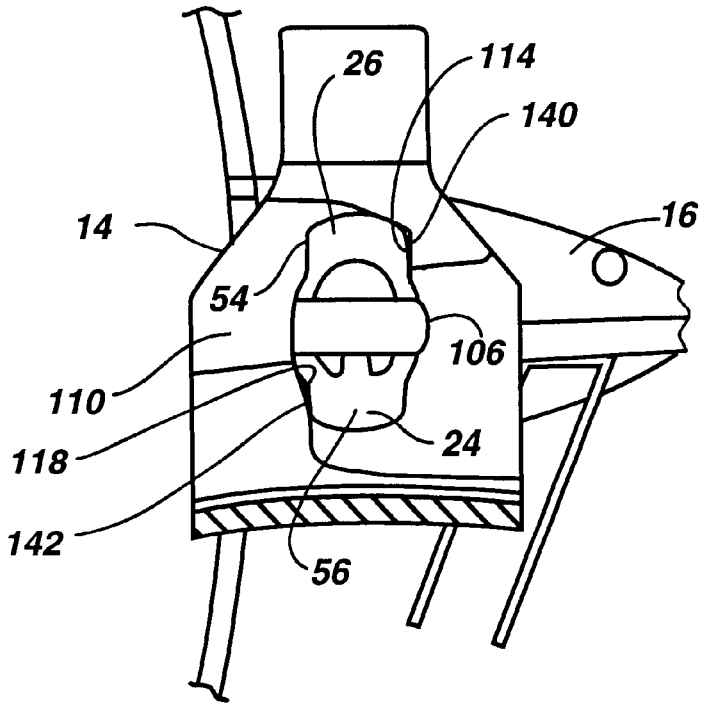
FIGS. 7A, 7B and 7C are top, side and partial cross-sectional top views of a camming belt clip in an open position in accordance with the principles of the present invention.
Figure 7B:
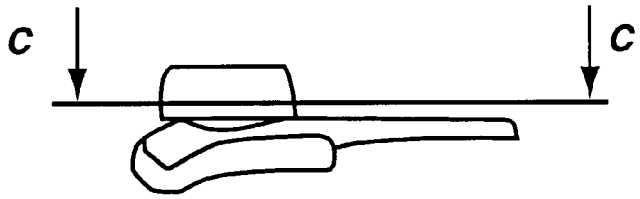
Figure 7A:
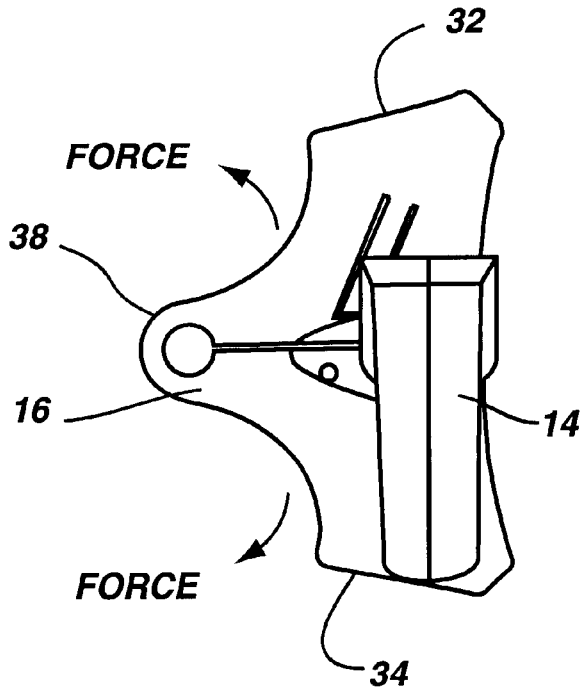

As shown in FIGS. 7A, 7B and 7C, as the cam stops 54 and 56 snap over the surface 110 of the clip member 14, the cam members will separate until the cam followers (not visible) abut against the cam hole 106. Thus, the cam followers are forced against the inside surface of the cam hole 106 by the spreading force applied by the arched portion 38 to the wing portions 321 and 34. As this happens, the wing portions 32 and 34 will spread apart to the "OPEN POSITION," the widest configuration of the back plate 16 after being assembled to the clip member 14. In this position, the cam stop side surfaces 140 and 142 are in position to abut against the open cam stop abutment surfaces 114 and 118, respectively, in order to prevent over rotation of the clip member 14 in an open direction. In this position, the gripping flanges (not visible) of the back plate 16 are opened wide enough to receive an electronic device for which they are configured therein between.

Figure 8C:
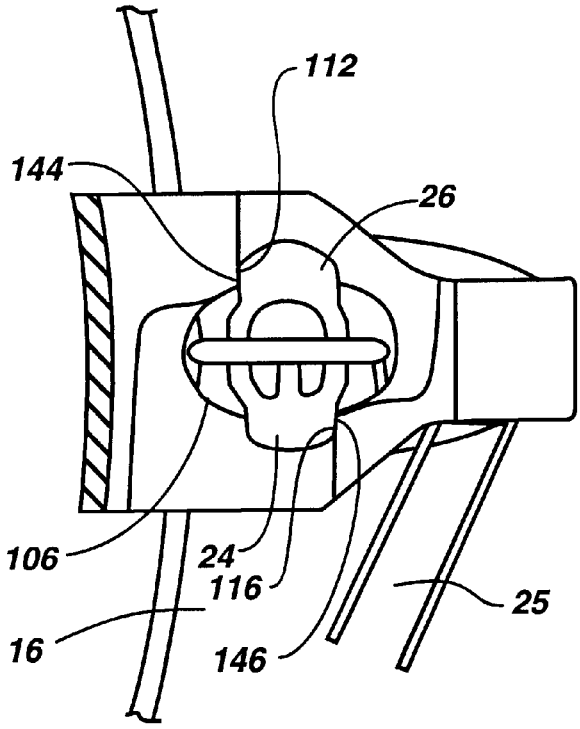
FIGS. 8A, 8B and 8C are top, side and partial cross-sectional top views of a camming belt clip in a closed position in accordance with the principles of the present invention.
Figure 8B:
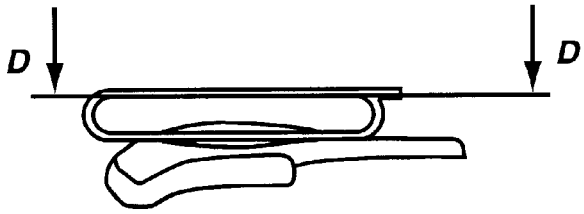
Figure 8A:
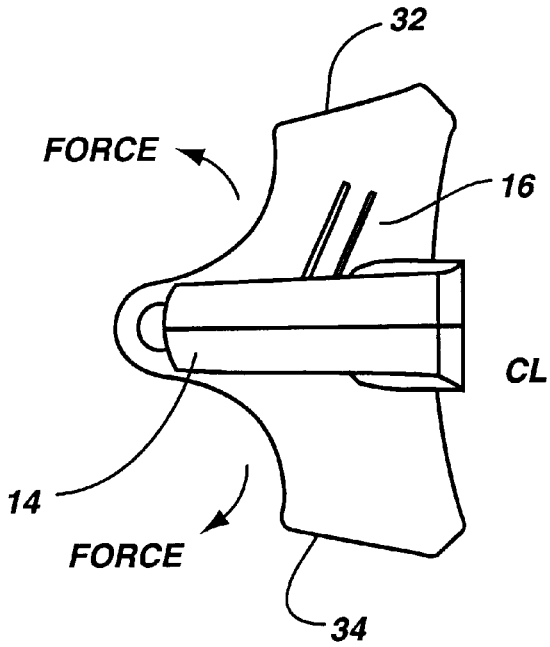

Once the electronic device is properly aligned with the back plate 16 and it is desired to secure the belt clip of the present invention to the device, the clip member 14 is rotated from its position as shown in FIG. 7A to the position of the clip member 14 shown in FIGS. 8A, 8B and 8C. In this position, the wing portions 32 and 34 are being biased as shown by force arrows to maintain engagement of the cam members with the cam hole 106. Furthermore, the engagement of the cam hole 106 with the cam members 24 and 26 in this position places the cam members 24 and 26 in their closest relative position such that the wing members 32 and 34 are pulled together by the cam hole 106. The clip member 14 is then held in place by the locking tab 25 which engages and secures the clip member 14 relative to the back plate 16. Finally, to prevent over rotation of the clip member 14 in the closed direction, the closed cam stop abutment surfaces 112 and 116 abut against the cam stop side surfaces 144 and 146, respectively.

When it is desired to return the back plate 16 to the open position shown in FIGS. 7A–7C, the locking tab is depressed so as to become disengaged from the clip member 14. The clip member 14 can then be freely rotated back to the open position. Once assembled, however, there is no need to disassemble the clip member from the back plate 16 and the configuration of the engagement of the clip member 14 to the back plate 16 allows the clip member 14 to stay attached to the back plate even when the clip member s place in the open position.

Those of skill in the art will appreciate that the illustrated embodiments of the camming belt clip of the present invention is configured for attachment to a specific electronic device, namely the IOMEGA Corporation HIPZIP. In order to utilize the present invention on various other electronic devices, whether presently known in the art or later developed, the relative dimensions and contour of the back plate would be modified to match that of the particular electronic device. Also, the flanges or gripping features would be modified to engage with any surface features on the electronic device to provide adequate attachment of the back plate to the particular electronic device. Moreover, while the belt clip member of the present invention is configured to be attachable to a belt or other strap-like article, such as a mounting strap or the waistband of a pair of pants or shorts, reference herein to a belt clip member is intended to encompass any type of attachment device for attaching the belt clip member to the clothing or body of a user. For example, the belt clip member may be configured to receive an elastic strap configured to be secured to the upper arm of a user.

While the methods and apparatus of the present invention has been described with reference to certain preferred embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. A belt clip for attaching a device to a user, comprising:

a right gripping portion and a left gripping portion, said right and left gripping portions configured to engage with an external surface of a device;

a biasing member coupled between said right gripping member and said left gripping member for biasing said right gripping member away from said left gripping member;

a right cam member secured relative to said right gripping member and a left cam member secured relative to said left gripping member; and a clip member defining a cam hole for engaging said right and left cam members such that rotation of said clip member causes said right and left cam members and thus said right and left gripping members to move relative to one another.

2. The belt clip of claim 1, further including a back member comprising right and left wing portions.

3. The belt clip of claim 2, wherein said right gripping portion is integrally formed with said right wing portion and said left gripping portion is integrally formed with said left wing portion.

4. The belt clip of claim 3, wherein said right and left gripping portions comprise elongate flanges spaced from a back side of said back member, said elongate flanges inwardly extending from proximate outer edges of said right and left wing portions.

5. The belt clip of claim 4, wherein said elongate flanges substantially match a contour of an electronic device to which the elongate flanges are to be attached and are configured to fit within exterior features formed in the electronic device.

6. The belt clip of claim 2, wherein said right and left wing portions are joined together by said biasing member, said biasing member comprising an integrally formed member interposed between said right and left wing members.

7. The belt clip of claim 6, wherein said right and left wing members depend from one another by said biasing member, said biasing member forming an arched-shaped portion defining a round aperture between said right and left wing portions.

8. The belt clip of claim 2, wherein said right wing member defines a first transversely extending recess along a portion of an inner edge thereof on a first side of the back member, and said left wing member defines a second transversely extending recess along an inner edge thereof on a second side of the back member, said first and second transversely extending recesses configured to overlap one another when the right wing member is forced toward said left wing member.

9. The belt clip of claim 8, further including a laterally extending post extending from said right wing member for engaging with a top surface of said left wing member, said post and said overlapping recesses preventing relative movement of said right and left wing members in a direction substantially perpendicular to a plane defined by said top surface.

10. The belt clip of claim 2, further including a locking member coupled to said right wing member for engaging with said clip member when said clip member is in a closed position.

11. The belt clip of claim 10, wherein said locking member comprises a cantilevered member integrally formed with said right wing member and having a raised locking portion integrally formed therewith, said raised locking portion configured to engage with said clip member, and said cantilevered member being flexible for selective disengagement of said raised locking portion from said clip member when pressed.

12. The belt clip of claim 11, wherein said clip member defines a recess in a side facing said cantilevered member for receiving said raised locking portion when said clip member is rotated to a closed position relative to said back member.

13. The belt clip of claim 1, wherein each of said cam members further include a cam stop for engaging with cam stop abutments on said clip member to prevent over rotation of said clip member relative to said cam members.

14. The belt clip of claim 13, wherein said cam stop members and said cam stop abutments allow said clip member to rotate approximately ninety degrees relative to said cam members between an open position and a closed position.

15. The belt clip of claim 14, wherein said gripping members are closer together when said clip member is in a closed position and further apart when said clip member is in an open position.

16. The belt clip of claim 15, wherein said biasing member forces said cam members against said cam hole.

17. The belt clip of claim 13, wherein said clip member defines first and second open position cam stop abutments for abutting against said cam stops and preventing over rotation of said clip member in a first direction and first and second closed position cam stop abutments for abutting against said cam stops and preventing over rotation of said clip member in second direction.

18. The belt clip of claim 17, wherein said clip member comprises an integrally formed cam portion defining said cam hole and including said cam abutment surfaces and a belt loop portion for receiving and holding an article of clothing of a user.

19. A belt clip for securing a device to a user, comprising:

a clamping member having integrally formed first and second wing portions interconnected by an arch-shaped portion;

a first grasping flange integrally formed with said first wing portion on a first side thereof and a second grasping flange integrally formed with said second wing portion;

a first cam member integrally formed with said first wing portion and a second cam member integrally formed with said second wing portion;

a clip member for attachment to a user defining a cam hole for receiving said first and second cam members, said clip member being rotatable relative to said clamping member between a first open position and a second closed position, whereby rotation of said clip from said first open position to said second closed position forces said first cam member toward said second cam member thus moving said first grasping flange toward said second grasping flange.

20. The belt clip of claim 19, wherein said grasping flanges are spaced from a back side of said clamping member and inwardly extend from proximate outer edges of said first and second wing portions.

21. The belt clip of claim 20, wherein said grasping flanges substantially match a contour of a device to which the flanges are to be attached and are configured to fit within exterior features formed in the device.

22. The belt clip of claim 19, wherein said arch-shaped portion biases said first wing member relative to said second wing portion.

23. The belt clip of claim 22, wherein said arch-shaped portion defines a circular aperture between said first and second wing portions.

24. The belt clip of claim 19, wherein said first wing portion defines a first transversely extending recess along a portion of an inner edge thereof on a first side of said clamping member, and said second wing member defines a second transversely extending recess along an inner edge thereof on a second side of said clamping member, said first and second transversely extending recesses configured to overlap one another when said first wing member is forced toward said second wing member.

25. The belt clip of claim 24, further including a laterally extending post extending from said first wing portion for engaging with a top surface of said second wing portion, said post and said overlapping recesses preventing relative movement of said first and second wing portions in a direction substantially perpendicular to a plane defined by said top surface.

26. The belt clip of claim 19, further including a cantilevered locking member integrally formed with said first wing portion for engaging with a corresponding recess in said clip member when said clip member is in said second closed position, said locking member having a raised locking portion integrally formed therewith, said cantilevered locking member being flexible relative to said first wing portion for selective disengagement of said raised locking portion from said clip member when said cantilevered locking member is sufficiently flexed.

27. The belt clip of claim 19, wherein said first and second cam members further include cam stops and said clip includes cam stop abutments for abutting said cam stops to prevent over rotation of said clip member relative to said cam members.

28. The belt clip of claim 27, wherein said cam stop members and said cam stop abutments allow said clip member to rotate approximately ninety degrees relative to said cam members between an open position and a closed position.

29. The belt clip of claim 28, wherein said grasping flanges are closer together when said clip member is in said second closed position and further apart when said clip member is in an open position.

30. The belt clip of claim 22, wherein said arch-shaped portion forces said cam members against said cam hole.

31. The belt clip of claim 28, wherein said clip member defines first and second open position cam stop abutments for abutting against said cam stops and preventing over rotation of said clip member in a first direction and first and second closed position cam stop abutments for abutting against said cam stops and preventing over rotation of said clip member in a second direction.

32. The belt clip of claim 19, wherein said clip member comprises an integrally formed cam portion defining said cam hole and including said cam abutment surfaces and a belt loop portion for securing said clip member to a user.

* * * * *